United States Patent [19]

Shuster et al.

[11] 4,384,937

[45] May 24, 1983

[54] PRODUCTION OF CHROMIC ACID IN A THREE-COMPARTMENT CELL

[75] Inventors: Nicholas Shuster, Perry; Andrew D. Babinsky, Chagrin Falls, both of Ohio

[73] Assignee: Diamond Shamrock Corporation, Cleveland, Ohio

[21] Appl. No.: 43,378

[22] Filed: May 29, 1979

[51] Int. Cl.[3] ..... C25B 9/00

[52] U.S. Cl. ..... 204/237; 204/257; 204/258

[58] Field of Search ..... 204/87, 97, 130, 257–258, 204/237

[56] References Cited

U.S. PATENT DOCUMENTS

| | | | |
|---|---|---|---|
| 2,081,787 | 5/1937 | Boss | 204/9 |
| 2,099,658 | 11/1937 | Pearson et al. | 204/9 |
| 3,222,267 | 12/1965 | Tirrell et al. | 204/98 |
| 3,305,463 | 2/1967 | Carlin | 204/89 |
| 3,454,478 | 7/1969 | Carlin | 204/130 |
| 3,523,755 | 8/1970 | McRae | 204/98 |

FOREIGN PATENT DOCUMENTS

| | | | |
|---|---|---|---|
| 739447 | 7/1966 | Canada | 204/57 |
| 52-65182 | 5/1977 | Japan . | |

*Primary Examiner*—R. L. Andrews

*Attorney, Agent, or Firm*—John J. Freer; Bruce E. Harang

[57] ABSTRACT

Chromic acid is now efficiently prepared in a process using dichromate, such as the dichromate typically available as an intermediate in the chromic acid production from chrome ore. In the process, the dichromate is introduced into the center compartment of a three-compartment electrolytic cell and dichromate-containing center compartment electrolyte flows through a porous diaphragm into the anode compartment of the cell. Electrolyte is introduced to the cell cathode compartment which is separated from the center compartment by a substantially hydraulically impermeable cation-exchange membrane means. During electrolysis, chromic acid is prepared in the anolyte and alkali product is produced in the catholyte.

18 Claims, 1 Drawing Figure

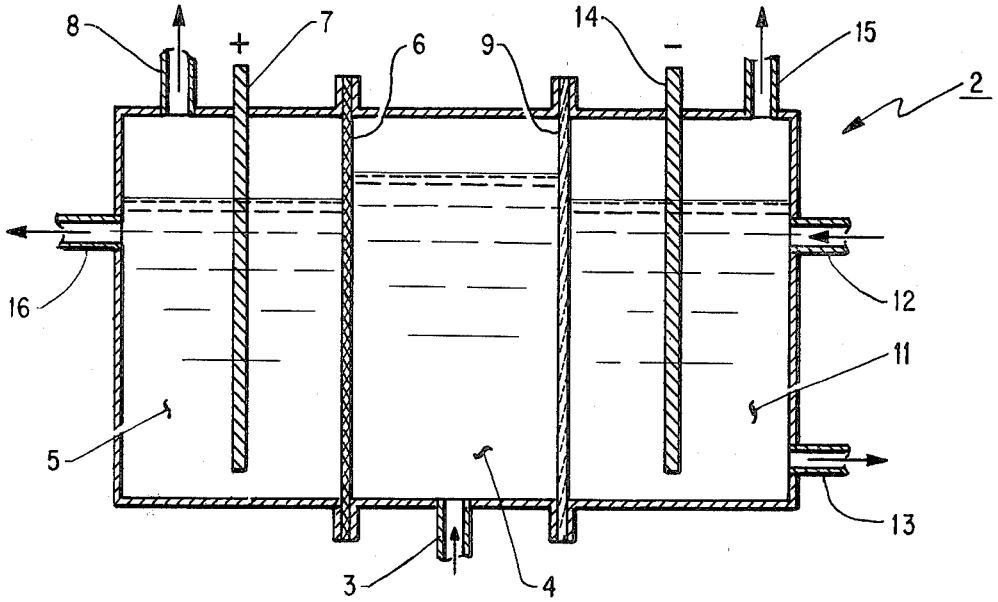
Fig.

PRODUCTION OF CHROMIC ACID IN A THREE-COMPARTMENT CELL

BACKGROUND OF THE INVENTION

The alkali roasting of chrome ore will provide a product that when leached with water yields an aqueous alkaline solution containing alkali metal chromate. This solution can then be reacted with acid to yield the dichromate. Sulfuric is a useful acid and a process employing same has been taught in U.S. Pat. No. 2,612,435. Carbon dioxide is also useful, and a showing of its use has been made in U.S. Pat. No. 2,931,704.

It has not been unusual for the roasting of the ore to introduce chloride ions which contaminate the aqueous solution as sodium chloride. In order to remove this sodium chloride impurity, it has been taught in U.S. Pat. No. 3,454,478 that the major processing steps can be supplemented with a two-compartment electrolytic cell. This cell will be located along side the processing stream, and before the sodium dichromate crystallizer. The cell can be fed a small bleed stream that is electrolyzed, thereby removing the chloride as chlorine gas at the anode, and the dichromate liquor from the anode compartment of the cell is returned to the main process stream.

In U.S. Pat. No. 2,099,658, it is shown to electrolytically produce chromic acid using a sacrificial anode. The process yields a contaminated product or requires an ostensibly cumbersome and inefficient step-wise procedure to achieve relatively impurity-free acid.

It has also been taught, as in Canadian Pat. No. 739,447, that sodium dichromate can be fed directly to the anode compartment of a two-compartment cell in the process of preparing chromic acid. The efficiency of such operation, however, has not proven satisfactory.

SUMMARY OF THE INVENTION

It has now been found that dichromate can be effectively processed to prepare chromic acid, wherein the process uses an electrolytic cell having desirably high current efficiency. Other aspects of the process include pollution reduction and the facilitation of impurities removal during processing.

In its broadest scope, the invention is involved in the production of chromic acid from dichromate and comprises: (A) introducing dichromate to the center compartment of a three-compartment electrolytic cell, the dichromate containing reduced forms of chromium, if such exist, at substantially below about 2 percent of the dichromate hexavalent chromium, the center compartment having porous diaphragm means between same and an anode compartment, and further having substantially hydraulically impermeable cation-exchange membrane means between the center compartment and a cathode compartment; (B) permitting center compartment dichromate-containing electrolyte flow through the porous diaphragm from the center compartment to the anode compartment; (C) establishing electrolyte in the cathode compartment; and (D) applying electrolyzing current to the electrolytic cell; thereby preparing chromic acid in the anode compartment of the cell.

In another aspect, the invention is directed to an electrolytic cell for the production of chromic acid from dichromate. The cell comprises: (A) an anode compartment in juxtaposition with a center compartment of the cell and containing an anode, the anode compartment further containing aqueous chromic-acid-containing anolyte at elevated temperature but below boiling condition, the anolyte containing dichromate and having an anolyte ratio below 20.8 percent. The cell also has: (B) a center compartment containing aqueous dichromate-containing electrolyte at elevated temperature but below boiling condition, which electrolyte comprises 0–100 grams per liter of alkali product, 0–100 grams per liter of chromic acid and below about 1600 grams per liter of dichromate, with the total of the hexavalent chromium in said electrolyte, expressed as $Cr^{+6}$, being above about 100 grams per liter, and with any reduced forms of chromium, if such exist, being present at substantially below about 2 percent of the hexavalent chromium, and wherein the center compartment is separated at least in part from cell anolyte by porous diaphragm means and at least partially from cell catholyte by substantially hydraulically impermeable cation-exchange membrane means. Lastly, the cell contains: (C) a cathode compartment in juxtaposition with the center compartment, the cathode compartment having a cathode and containing aqueous catholyte at elevated temperature but below boiling condition.

In another aspect, the invention comprises establishing the presence of carbon dioxide in the cathode compartment of the cell thereby preparing carbonate product in the catholyte.

As used herein, the term "alkali product" refers to alkali metal hydroxide and or ammonium hydroxide, as well as referring to carbonate product, any or all of which can be in mixture and may be in solution. The term "carbonate product" refers to any or all, and including mixtures, of the carbonates and bicarbonates of ammonium and alkali metals. Also as used herein, the term "solution" is contemplated to include a slurry and/or the supplemental addition of solid product where such would be apparent to those skilled in the art. For example, a sodium dichromate solution feeding to the center compartment of the electrolytic cell may be in slurry form. Also, this solution or slurry may be supplemented as, for example, to occasionally boost sodium dichromate concentration, with the addition of solid sodium dichromate.

DESCRIPTION OF THE DRAWING

The FIGURE is a diagrammatic representation of an electrolytic cell, in vertical cross section, useful in the present invention.

DESCRIPTION OF THE PREFERRED EMBODIMENTS

In the process for preparing chromic acid in accordance with the present invention and referring to the FIGURE, dichromate, feeding from a source not shown, passes through an inlet 3 to the center compartment 4 of a three-compartment electrolytic cell 2. Advantageously, to enhance cell operating efficiency, the dichromate feed will be substantially free from chromic acid. e.g., contain a few weight percent at most of chromic acid. This assists in minimizing the presence of chromic acid in the center compartment. Preferably, for best efficiency, this feed is free from chromic acid. The typical dichromate solution entering the cell will be at a temperature within the range from about 15° C. to about 95° C. Also, for augmented process efficiency, the feed will be more than about 30 weight percent and, advantageously, more than about 40 weight percent of dichromate. Moreover, with sodium dichromate as an example, and with a feed solution temperature of about 85°–95° C., the weight percent of the sodium dichromate might be on the order of 70–90 weight percent. If reduced forms of chromium, e.g., trivalent chromium, are contained in the feed, i.e., if such exist therein, such feed should be substantially free from such reduced forms. That is, the reduced forms should be present in an amount substantially below about 2 percent of the dichromate hexavalent chromium, which percentage is advantageously only a peak amount that is not sustained. The presence of reduced forms of chromium in the feed may lead to the formation of deleterious precipitates in the center compartment of the cell. Hence, if they exist in the feed at all, these reduced forms are advantageously present in an amount below about one percent of the dichromate hexavalent chromium. Preferably, for best ease of operation, the feed is free from reduced forms of chromium. It is contemplated that the dichromate feed will be one or more of the group of sodium, potassium or ammonium dichromate. Ammonium dichromate might be most readily a variable from industrial operations wherein dichromate is obtained as a by-product or the like which may, for example, be processed into a more useful commercial substance. Because of ready commercial availablility, sodium dichromate is the preferred dichromate feed.

Referring again to the FIGURE, from the center compartment 4 of the cell 2, the dichromate flows into the anode compartment 5 through a porous diaphragm 6, although it is contemplated that supplemental dichromate might be fed directly to the anolyte, such as through an anode compartment inlet, not shown. The anode compartment 5 contains an anode 7 and is equipped with an outlet 8 for the removal of gaseous oxygen. A membrane 9 separates the center compartment 4 and a cathode compartment 11 of the cell 2. Aqueous electrolyte can be introduced into the cathode compartment 11 through an inlet line 12. Although it is contemplated that this electrolyte might be no more than simply tap water, it is preferably primed at the outset of cell operation for enhanced cell efficiency at start-up. As an example, alkali metal hydroxide is suitable for priming. Thereafter, during electrolysis, the alkali product concentration of the catholyte may be at least partially controlled by water addition through the inlet line 12, or such addition to recirculating catholyte, not shown, or by the addition of such dilute aqueous solution as can be provided by introducing carbon dioxide to the catholyte feed. A product concentration in the catholyte, for sodium hydroxide, as an example, on the order of up to about 450 grams per liter can be advantageous for efficient operation, while such concentrations of 600 grams per liter, or more, are contemplated. Alkali product will be removed from the cathode compartment during continuous electrolysis through an outlet line 13. The cathode compartment 11 contains a cathode 14 and has an outlet 15 for the removal of gaseous hydrogen. During or following electrolysis, chromic-acid-containing solution is withdrawn from the anode compartment 5 through a product withdrawal line 16, and this solution may be further processed, as in downstream chromic acid recovery means.

In typical cell operation, the anolyte can be initially free from chromic acid. In this case, the anolyte ratio, using a sodium-dichromate-containing anolyte as an example, is at 20.8 percent, and for a potassium-dichromate-containing anolyte, will be at 31.95 percent. This ratio for the anolyte is defined as the alkali metal (or ammonium) oxide concentration in the anolyte divided by the sum of the anolyte chromic acid concentration plus the alkali metal (or ammonium) dichromate dihydrate concentration. The ratio is expressed as a percentage. All concentrations are in equivalent units, such as grams per liter, when calculating the ratio. For the case of sodium oxide as an example, it would be expressed as $Na_2O$. In cell operation and using sodium dichromate as an example, for ease in subsequent chromic acid crystallization, it is preferable to continue electrolysis until the anolyte ratio reaches a percentage at least on the order of about 11–13 percent. For most efficient overall operation, the electrolysis will not provide a ratio for the anolyte extending below about 3 percent. Likewise, in considering the efficiency of the operation, the anolyte chromic acid concentration will not exceed about 1200 grams per liter of anolyte. If the cell is operated continuously, the acid concentration in the anolyte will often range from about 100 grams per liter to about 800 grams per liter. Also, in continuous operation electrolyzing sodium dichromate, at current densities of about 2–3 asi and anolyte ratios within the range from about 4 percent to 8 percent, anolyte current efficiencies can be expected to range from around 50 percent to as high as about 80 percent.

The electrolytic cell used in the invention process may be a single cell or a plurality of cells combined together into a single electrolyzing unit either in series using bipolar electrodes or in parallel. The cell operation is preferably ongoing and will typically be described as such herein. Referring to a single cell unit, the cell will, preferably, achieve a pressure differential between the center compartment and the anode compartment to enhance the flow of center compartment liquid into the anode compartment. This differential can be obtained by pumping the feed through the center compartment or by maintaining a hydrostatic head of cell solution in the center compartment as shown in the FIGURE. An achieved pressure differential of above 0 psig and of up to about 1 psig has been found to be suitable, while such up to about 2 psig is contemplated. All electrolytes can be maintained at essentially atmospheric pressure. By this it is meant that no additional pressure is contemplated other than resulting from cell operation, such as might be associated with a hydrostatic head of solution in the center compartment, or with the addition of carbon dioxide to the catholyte, or the like. The center compartment can also be equipped with an outlet for passing depleted center compartment solution out of the cell, although cell feed can be in balance with the flow of center compartment solution through the porous diaphragm to the anode compartment. This solution flow provides fresh feed for the anolyte, and the solution sweeping into the anolyte will retard migration of hydrogen ions from the anode compartment. In the center compartment, the dichromate-containing electrolyte will be at elevated temperature, but below boiling condition. For efficiency of operation, the center compartment will contain less than about 100 grams per liter of alkali product, or if chromic acid is present, i.e., alkali product is not, then it will contain less than 100 grams per liter of chromic acid. More often, the concentration of the alkali product, and of the chromic acid, in the center compartment will be 0, or near 0. When it is 0 for the acid and sodium dichromate is present as the dichromate, the anolyte ratio will be at 22.8 percent. On the other hand, the dichromate concentration may be as great as up to about 1600 grams per liter, although a concentration within the range from above about 200, or advantageously for efficient acid production of above about 600, up to about 1200 grams per liter is more usual. For efficient chromic acid production, the total of the hexavalent chromium in the substances in the center compartment electrolyte as, for example, supplied by the dichromate, and expressed as $Cr^{+6}$, will be above about 100 grams per liter and, advantageously, for enhanced cell operating efficiency, will exceed 220 grams per liter. Also, for most efficient operation, it is preferred that the center compartment electrolyte be at least substantially free from reduced forms of chromium as has been discussed hereinabove in connection with the dichromate feed. Suitable materials of construction for the center compartment include titanium, glass, tantalum and fluorocarbon polymer lined materials. The center compartment does not contain an electrode.

The porous diaphragm may be constructed of any material compatible with the dichromate and chromic acid environment of the cell and which will also permit bulk hydraulic flow from the center compartment to the anolyte, as well as have appropriate electrical conductivity characteristics. An example of such material is asbestos. Of particular interest are diaphragms produced from fluorocarbon polymers, e.g., poly(fluorocarbons) which are copolymers of fluorocarbons and fluorinated sulfonyl vinyl ethers. The diaphragm may be in the form of a porous sheet of the poly(fluorocarbon) copolymer, or in the form of a porous base member having at least a portion of its surface coated with the copolymer. Suitable base members include poly(-fluorocarbons) and asbestos. The porous or poromeric sheets or coated base members will usually be in the form of sheets having a thickness of less than 0.25 inch to optimize cell efficiency. The typical porosity for such materials may range from 15 to 85 percent but is, preferably, below about 40 percent to retard backflow of anolyte solution to the center compartment. Individual pores may have areas on the order of from $8\times10^{-13}$ square centimeters to about $8\times10^{-5}$ square centimeters per pore when measured by the method described in ASTM Standard 02499. A description of these particular membranes has been made in West German Patent Publication No. 2,243,866. Other suitable diaphragm materials include acid resistant filter paper, ceramic, polyethylene, chlorofluorocarbon, poly(fluorocarbon) and other synthetic fabrics so long as they provide a relatively low electrical resistance. In this regard, electrolysis will be carried out with direct current at a current density between zero and about 10 amperes per square inch. A density within the range of about 1–4 asi is preferred for best efficiency.

The anode compartment will have, in addition to the product outlet for removing chromic-acid-containing solution, an outlet for removing oxygen gas evolved at the anode which may be in part mixed with trace amounts of impurity, e.g., gaseous halide impurity. It is contemplated that such impurity will be chlorine gas as the cell feed may be contaminated with alkali metal chloride, and the anode used may be one, such as those formed from valve metals bearing a noble-metal-containing coating that are discussed hereinbelow, which facilitate chlorine gas evolution. Suitable materials of construction for the anode compartment include glass and ceramic materials as well as polyfluorocarbon lined materials. The anode compartment may also have an inlet for introducing chromic-acid-containing solution directly to the anolyte, such as might be available as mother liquor after chromic acid crystals are removed from a solution rich in chromic acid.

The anode used in the electrolytic cell may be any conventional, electrically conductive, electrocatalytically active material resistant to the anolyte such as the lead alloy types used commercially in plating operations. Lead and lead alloy anodes are preferred. Other useful anodes include those that are formed from a valve metal such as titanium, tantalum or alloys thereof bearing on its surface a noble-metal-containing coating, i.e., a coating of a noble metal, or a noble metal oxide (either alone or in combination with a valve metal oxide). The coating can also be supplied from other electrocatalytically active, corrosion-resistant material. Anodes of this class are called dimensionally stable anodes and are well-known and widely used in industry. See, for example, U.S. Pat. Nos. 3,117,023; 3,632,498; 3,840,443; and 3,846,273. While solid anodes may be used, foraminous anodes having about 25 percent or more of their surface area open, such as an expanded mesh sheet, woven mesh screen, or perforated plate, are preferred since they have greater electrocatalytic surface area and facilitate the flow of fluids in the anolyte compartment, e.g., facilitate the removal of oxygen gas from the compartment. The anode can be in juxtaposition with the diaphragm or laminated to the diaphragm.

The center compartment will be separated from the cathode compartment by a membrane. The membrane may be, in general, any hydraulically impermeable cation-exchange membrane electrolytically conductive in the hydrated state obtaining under cell operating conditions and compatible with the environment, i.e., chemically resistant to the catholyte and the center compartment electrolyte. These membranes may comprise a film of a polymer, chemically resistant to the feed solution and catholyte. When such structure is present, the film will, preferably, contain hydrophylic, ion-exchange groups such as sulfonic groups, carboxylic groups and/or sulfonamide groups. Membranes made from polymers containing sulfonic and/or carboxylic groups have been found to have good selectivity (that is, they transport virtually only alkali metal ions) and low-voltage characteristics for the production of alkali metal hydroxide, or carbonate or bicarbonate, in the catholyte, while membranes containing sulfonamide groups may be useful in obtaining higher caustic current efficiencies, but require a somewhat higher electrolyzing voltage. Typically, these membrane polymers have an ion-exchange group equivalent weight of about 800–1500 and the capacity to absorb, on a dry basis, in excess of 5 weight percent gel water.

The cation of the ion-exchange group (representative groups being $-CO_2H$, $-SO_3H$,

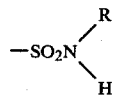

and the like) in the membrane will mostly be alkali metal, i.e., the same alkali metal as present in the cell feed. While the acid or other alkali metal salt form can be employed at start-up, it will be appreciated that the membrane will exchange virtually all of these cations for the cation of the dichromate cell feed within a relatively short period of cell operation. Polymers having all of their hydrogens replaced with fluorine atoms or the majority with fluorine atoms and the balance with chlorine atoms, and having the ion-exchange groups attached to a carbon atom having at least one fluorine atom connected thereto, are particularly preferred for maximum chemical resistance.

To minimize electrolyzing voltage, the membrane, preferably, has a thickness in the range of about 3 to 10 mils, with thicker membranes in this range being used for better durability. The membrane will typically be laminated to and impregnated into a hydraulically permeable, electrolytically nonconductive, inert reinforcing member such as a woven or nonwoven fabric made from fibers of asbestos, glass, poly(fluorocarbons) and the like. In film-fabric laminated membranes, it is preferred that the laminate have an unbroken surface of the film resin on both sides of the fabric to prevent leakage through the membrane caused by seepage along the fabric yarns. Such laminates and methods for their manufacture are disclosed in U.S. Pat. No. 3,770,567. Alternatively, films of the membrane polymer may be laminated to each side of the fabric.

Suitable membranes are available from the E. I. duPont de Nemours & Co. under the trademark NAFION. The preparation and description of suitable NAFION and other types of membranes is provided, among others, in British Pat. No. 1,184,321, German Patent Publication No. 1,941,847, U.S. Pat. Nos. 3,041,317; 3,282,875; 3,624,053; 3,784,399; 3,849,243, 3,909,378; 4,025,405; 4,080,270; and 4,101,395. By being "substantially hydraulically impermeable," as the term is used herein, these membranes under the broad ranges of cell operating conditions may be expected to afford virtually no transportation of cell electrolyte by direct flow through pores within the membrane structure.

The cathode used in the electrolysis cell can be any conventional electrically conductive material resistant to the catholyte, such as iron, mild steel, stainless steel, nickel, and the like. The cathode may be foraminous and gas permeable, e.g., having at least 25 percent of its surface area open, thereby facilitating the flow and removal of hydrogen gas in the catholyte compartment, and/or the circulation of carbon dioxide when such is introduced for production of carbonate or bicarbonate in the cathode chamber. To reduce the electrolyzing voltage, all or part of the surface of the cathode may bear a coating or layer of a material lowering the hydrogen overvoltage of the cathode, such as are disclosed in U.S. Pat. No. 4,024,044 (melt-sprayed and leached coating of particulate nickel and aluminum), U.S. Pat. No. 4,104,133 (electrodeposited coating of a nickel-zinc alloy), and U.S. Pat. No. 3,350,294 (coating of molybdenum and tungsten and cobalt, nickel or iron). Useful cathodes also include oxidizing gas depolarized cathodes. Such have been discussed, for example, in U.S. Pat. No. 4,121,992.

Suitable cathodes can be made from, for example, expanded mesh sheet, woven wire screen or perforated plates. The cathode may be a parallel-plate electrode, although other elongated electrode elements having other cross-sectional shapes, such as rond, elipsoid, triangular, diamond, and square, can be utilized. The cathode can be in juxtaposition with the membrane or laminated to the membrane. For efficiency and economy, nickel plated steel cathodes are preferred.

The cathode compartment will be provided with an electrolyte inlet for introducing an electrolyte, such as water preferably primed at cell start-up as discussed hereinabove. The compartment will possibly also have an inlet for introducing carbon dioxide to such cathode chamber, or carbon dioxide can be introduced to catholyte recirculating outside the cell, if the production of other than alkali metal hydroxide is desired. The cathode compartment will have a product outlet for the removal of catholyte solution, i.e., resulting alkali product, and an outlet for hydrogen gas escape. In cell operation, the movement of ions such as alkali metal ions into the cathode chamber will be desirably facilitated by the membrane, while the transport across the membrane of the hydroxyl ions of the catholyte and dichromate ions of the center compartment will be impeded. When the dichromate feed is contaminated with metallic ions, particularly those of calcium, magnesium and the heavy metals, the membrane can serve to scavange these ions from the center compartment solution, thereby enhancing the production of more purified chromic acid product.

Although incoming cell electrolytes can be at room temperature, the cell will operate at elevated temperature so that the cell electrolytes will be at elevated temperature but, for efficient cell operation, below boiling condition. Elevated temperature results in increased solution conductivity and, hence, lower cell voltages. Generally, the cell electrolytes will be at an elevated temperature above about 40° C. and, advantageously, will be at a temperature above about 60° C. Preferably, for most efficient conductivity, the cell electrolytes are at a temperature within the range from about 80° C. to about 95° C. In addition to the heat generated in the cell, or contributed by incoming solutions, the feed lines may be heated or a heater placed in the cell to provide additional heat input.

The following examples show ways in which the invention has been practiced, but should not be construed as limiting the invention.

EXAMPLES 1-6

The electrolysis cell used in the examples was of sufficient size to accommodate electrodes of 3 square inches in projected frontal surface area. The cell had polytetrafluoroethylene gasketing between the center and cathode compartments, as well as between the center and anode compartments of the cell. Outlet vents were provided for passage of oxygen at the anode and hydrogen at the cathode.

The sodium dichromate feed stream was pumped into the bottom of the center compartment of the cell at a temperature of about 20° C. The strength varied between about 500 and 600 grams per liter (g/l) of sodium dichromate, and the feed also contained trace quantities of sodium chloride and metal ion impurities. The center compartment, sometimes called the feed compartment, was constructed of titanium.

The anode compartment of the electrolytic cell was constructed of glass and contained a circular anode having a surface area of 3 square inches. The anode used was an expanded mesh titanium metal anode being a tantalum oxide/iridium oxide coating. Such anodes are described in U.S. Pat. No. 3,878,083. The hydraulically permeable porous diaphragm separating the feed compartment from the anode compartment was an about 21 mils thick member of a perfluorosulfonic acid copolymer deposited on a polytetrafluoroethylene mesh substrate.

The cathode compartment was constructed of a acrylic plastic. The cathode chamber contained an array of nickel parallel plate cathodes, designed to facilitate hydrogen gas release and provided a projected frontal surface area of 3 square inches. When carbon dioxide was used, as shown in the table, it was introduced into the rear of the cathode compartment at the bottom of the cell. Separating this compartment and the feed compartment was a substantially hydraulically impermeable cation-exchange membrane. The membrane used was an about 14 mils thick film comprised of an integral layer of a copolymer laminated to a square-woven polytetrafluoroethylene fabric. The layer laminated to the fabric had a thickness of about 7 mils and comprised a copolymer having recurring units of:

$$-CF_2-CF_2-$$

and $$-CF_2-\underset{\underset{O-CF_2-\underset{\underset{CF_3}{|}}{CF}-O-CF_2-CF_2-SO_3H}{|}}{CF}-$$

and an equivalent weight of about 1100.

The cell temperature varied between 85° C. to 95° C., with supplemental heat being provided as needed by a heater in the anode compartment. A hydrostatic liquid head difference was maintained between the center and anode chambers. This created a pressure drop of less than one psig across the porous diaphragm and allow bulk flow from the center to the anolyte compartment. The feed solution was entering the center compartment at a rate of approximately 3.5 milliliters/minute (ml/min). Into the cathode compartment, distilled water entered at a temperature of about 20° C., and the compartment was primed with sodium hydroxide prior to initiation of electrolysis.

Depleted sodium dichromate solution was removed from a line near the top of the hydrostatic head of the center compartment. The flow rate for the depleted feed stream varied from zero to 3.5 ml/min. From the vent line at the top of the anode chamber, oxygen gas, sometimes containing a trace of gaseous chlorine, was vented off. From the vent line at the cathode chamber, hydrogen was removed.

In the table, the anolyte ratio, by definition, is the ratio of the alkali metal oxide concentration, i.e., the $Na_2O$ concentration (g/l) in the anolyte, to the sum of the anolyte chromic acid concentration (g/l) plus sodium dichromate dihydrate concentration (g/l), expressed as a percentage. Other process parameters and the results obtained are as shown in the table.

TABLE

| Example | Current Density (asi) | Anolyte Ratio: % | Anolyte $CrO_3$ Current Efficiency: % | $CO_2$ Addition | Catholyte Current Efficiency: % |
|---|---|---|---|---|---|
| 1 | 3 | 4.1 | 56.5 | No | 47.7 |
| 2 | 3 | 4.9 | 55 | No | 50.2 |
| 3 | 2 | 5.8 | 66.2 | Yes | 63 |
| 4 | 3 | 5.6 | 64.3 | Yes | 78 |
| 5 | 3 | 4.9 | 58.8 | Yes | 80.6 |
| 6 | 3 | 4.0 | 58.9 | Yes | 77.5 |

The reported anolyte and catholyte efficiencies are regarded as correct within a margin of about ±1 or 2 percent. For the cell, there is a center compartment efficiency. It can be an acid or base efficiency, in accordance with the center compartment deviation (to acidic or basic, during electrolysis), from the pH of the incoming sodium dichromate feed stream, and which deviation is due to acid or base migration from the anolyte or catholyte compartments respectively. Thus, as representative of this phenomenon, the center compartment had an acid content equivalent to a current efficiency of 20.4 percent in Example 6.

In further tests, the production of water white caustic, i.e., caustic visually free from chrome contamination, was readily produced by substituting in the cell, for the above-described cation-exchange membrane, a similar membrane but having the pendant sulfur-containing groups reacted with ethylene diamine.

What is claimed is:

1. An electrolytic cell for the production of chromic acid from sodium dichromate, which cell comprises:
   (A) an anode compartment in juxtaposition with a center compartment of said cell and containing an anode, said anode compartment further containing aqueous chromic-acid-containing anolyte at elevated temperature but below boiling condition, said anolyte containing dichromate and having an anolyte ratio below 31.95 percent;
   (B) a center compartment containing aqueous dichromate-containing electrolyte at elevated temperature but below boiling condition, which electrolyte comprises 0–100 grams per liter of alkali product, 0–100 grams per liter of chromic acid and below about 1600 grams per liter of dichromate, with the total of the hexavalent chromium in said electrolyte, expressed as $Cr^{+6}$, being above about 100 grams per liter, and with any reduced forms of chromium, if such exist, being present at substantially below about 2 percent of said hexavalent chromium, and wherein said compartment is separated at least in part from cell anolyte by porous diaphragm means and at least partially from cell catholyte by substantially hydraulically impermeable cation-exchange membrane means; and
   (C) a cathode compartment in juxtaposition with said center compartment, said cathode compartment having a cathode and containing aqueous catholyte at elevated temperature but below boiling condition.

2. The electrolyte cell of claim 1 wherein said chromic-acid-containing anolyte of said anode compartment also contains sodium dichromate and has an anolyte ratio between about 3 and 20.8 percent.

3. The electrolyte cell of claim 1 wherein the anode is a metal anode wherein the metal is selected from the group consisting of lead, lead alloys and valve metals bearing a noble-metal-containing coating.

4. The electrolytic cell of claim 1 wherein said anolyte, catholyte and dichromate-containing electrolyte are all at elevated temperature maintained within the range from about 40° C. to about 95° C., and said dichromate-containing center compartment electrolyte is under a hydrostatic pressure maintained within the range from about 0 psig to about 2 psig, thereby enhancing flow of said electrolyte from said center compartment through the porous diaphragm.

5. The electrolytic cell of claim 1 wherein chromic acid is present in said anolyte in a concentration below about 1200 grams per liter and said anolyte is substantially free from reduced forms of chromium.

6. The electrolyte cell of claim 1 further characterized by having vent means for removing gas generated at the anode, and outlet means, separated from said vent means, for withdrawing chromic-acid-containing anolyte from said anode compartment.

7. The electrolytic cell of claim 1 wherein the dichromate inlet means to said anode compartment comprises said porous diaphragm means.

8. The electrolytic cell of claim 1 wherein said dichromate-containing electrolyte of said center compartment contains sodium dichromate.

9. The electrolytic cell of claim 1 wherein said porous diaphragm means comprises fluorocarbon polymer substance and said membrane means comprises a film of a polymer, chemically resistant to the catholyte and center compartment dichromate-containing electrolyte of said cell, and containing hydrophilic, ion-exchange groups selected from the group consisting of sulfonic groups, carboxylic groups, sulfonamide groups, and mixtures thereof.

10. The electrolytic cell of claim 1 further characterized by containing inlet means for introducing dichromate to said center compartment, and center compartment outlet means for withdrawing solution, depleted in dichromate, from said electrolytic cell.

11. The electrolytic cell of claim 10 wherein the dichromate introduuced to said center compartment is substantially free from chromic acid.

12. The electrolytic cell of claim 10 wherein the dichromate introduced to said center compartment is selected from the group consisting of sodium dichromate, potassium dichromate, ammonium dichromate and mixtures thereof.

13. The electrolytic cell of claim 1 further characterized by having materials in contact with said center compartment electrolyte selected from the group consisting of titanium, fluorocarbon polymer substance, polymer film containing hydrophilic ion-exchange groups, tantalum and glass, and materials in contact with said anolyte selected from the group consisting of glass, ceramic and fluorocarbon polymer substance.

14. The electrolytic cell of claim 1 wherein said catholyte contains less than about 600 grams per liter of alkali product.

15. The electrolytic cell of claim 1 further characterized by having vent means for removing gas generated at the cathode, and having outlet means for withdrawing alkali-product-containing catholyte, while further having inlet means to said cathode compartment.

16. The electrolytic cell of claim 15 wherein the alkali product concentration in said cathode compartment is at least partially controlled during electrolysis by water addition thereto through said inlet means, or by addition to catholyte being recirculated outside said cell, whereby said recirculating catholyte is introduced through said inlet means.

17. The electrolytic cell of claim 15 further characterized by introducing carbon dioxide into the catholyte through said inlet means, or by introducing carbon dioxide into catholyte being recirculated outside the cell, whereby said recirculating catholyte is introduced through said inlet means.

18. The electrolytic cell of claim 17 wherein carbonate product is withdrawn from said cell or from recirculating catholyte.

* * * * *